United States Patent [19]

Dumas et al.

[11] Patent Number: 4,631,546

[45] Date of Patent: Dec. 23, 1986

[54] ELECTRONICALLY ROTATED ANTENNA APPARATUS

[75] Inventors: Ted A. Dumas, Dallas, Tex.; Les V. Griffee, Marysville, Kans.

[73] Assignee: Rockwell International Corporation, El Segundo, Calif.

[21] Appl. No.: 691,335

[22] Filed: Jan. 14, 1985

Related U.S. Application Data

[63] Continuation-in-part of Ser. No. 483,793, Apr. 11, 1983, abandoned.

[51] Int. Cl.[4] ..... H01Q 3/44

[52] U.S. Cl. ..... 343/833; 343/846; 342/399

[58] Field of Search ..... 343/833–837, 343/846, 374, 399, 403, 406, 829

[56] References Cited

U.S. PATENT DOCUMENTS

| | | | |
|---|---|---|---|
| 1,860,123 | 5/1932 | Yagi | 343/833 |
| 3,560,978 | 2/1971 | Himmel et al. | 343/833 |
| 3,725,938 | 4/1973 | Black et al. | 343/833 |
| 3,846,799 | 11/1974 | Gueguen | 343/837 |
| 3,996,592 | 12/1976 | Kline et al. | 343/876 |

*Primary Examiner*—Eli Lieberman

*Attorney, Agent, or Firm*—Bruce C. Lutz; V. L. Sewell; H. Fredrick Hamann

[57] ABSTRACT

An antenna of the type having a central driven element and a plurality of surrounding parasitic elements is shown. Further, there is circuitry for modifying the basic omnidirectional pattern of said antenna to a directional pattern by normally capacitively coupling the parasitic elements to ground but on a selective basis changing some of the parasitic elements to be inductively coupled to ground whereby they act as reflectors and provide an eccentric signal radiation pattern. By cyclically altering the connection of various parasitic elements in their coupling to ground, a rotating directional signal is produced.

8 Claims, 3 Drawing Figures

ELECTRONICALLY ROTATED ANTENNA APPARATUS

The present application is a continuation in part of a previously filed application, Ser. No. 483,793, filed Apr. 11, 1983, now abandoned, in the name of Ted A. Dumas and assigned to the same assignee as the present invention.

The present invention is generally concerned with electronics and more specifically concerned with antennas. Even more specifically, it is concerned with an antenna which has a transmission or reception pattern that can be electrically altered to provide a directional signal pattern. This signal pattern can then be electronically rotated.

As is known to those skilled in the art, TACAN antenna systems typically have a ground based transmitter which produces a rotating signal pattern that is modulated in signal strength depending upon the orientation of the antenna. Typically, there is a further signal provided whenever the maximum signal strength is pointing a known reference direction relative to true north whereby a receiving station can note the occurrence of the north reference signal in the received carrier and ascertain the time between the north reference signal and the maximum strength received signal to ascertain the direction of the TACAN antenna as compared to the receiver. Although the north signal can take many forms in different systems, the TACAN approach is to momentarily pulse the main transmitted signal when the antenna is providing maximum signal strength to the east.

The prior art TACAN antenna systems used a large size mechanically rotating antenna to provide the direction oriented signal. However, such a device is mechanically complex and very heavy.

Omnidirectional antennas using parasitic elements around a driven element are certainly known in the past, as evidenced by patents to Yagi, U.S. Pat. No. 1,860,123, Black et al., U.S. Pat. No. 3,725,938 and others.

To do a good job of enhancing or directing the signal, the parasitic element must be capacitively coupled to ground. It has been found that if the parasitic elements are inductively coupled to ground, the parasitic elements act as a reflector and return the signal from the driven element back in the direction from whence it came. Thus, if some of the parasitic elements surrounding a driven element are in the reflector mode and the remaining are in the director mode, the signal transmitted from the antenna changes from omnidirectional to directional. If the set of elements, which comprise the ones being in the reflector mode, is continually changed in a rotating and cyclical basis, the directional signal pattern is then rotatable. The effect, as far as ascertained by remote receivers, is identical to that of a mechanically rotatable antenna.

From the above it will be apparent that the present invention finds a specific use as a rotating beam navigation antenna. In one embodiment, it utilizes nine parasitic elements arranged in a concentric circle around the center or driven element. All of the radio frequency components of this device are of fixed mechanical length as contrasted with variable length elements used in the prior art. As is realized by those skilled in the art, a monopole element alone provides an omnidirectional element pattern. Similarly, if all of the parasitic elements surrounding the central element are open at the base or if all of these parasitic elements are shorted at the base, an omnidirectional pattern will also result. However, by selectively shorting one or more of these identical length elements without shorting all of the elements, a shaped pattern can be achieved. As illustrated in the embodiment presented, three elements are typically operated at a time. Further, if the three selected parasitic elements are terminated in an inductive impedance, the parasitic elements act as a reflector. If the other six elements are terminated at the base in capacitive impedance, these parasitic elements function as directors and reinforce the signal from the driven element.

Thus, although Yagi and others have recognized the basic concept of using parasitic elements of various lengths in conjunction with a central unit, the present invention improves upon this prior art by using fixed length parasitic elements which have a terminating transmission line shielded from the driven element and a diode switch which alters the effective electrical length of this transmission line to cause the element to act either as a reflector or director by changing the impedance at the base of the parasitic element.

It is therefore an object of the present invention to provide an improved direction orientable antenna system.

Other objects and advantages of the present invention may be ascertained from a reading of the specification and appended claims in conjunction with the drawings wherein:

FIG. 1 is a schematic block diagram of the invention illustrating the shaped radiation pattern and the general method of terminating the parasitic elements;

FIG. 2 is a drawing illustrating in more detail the ground plane means and the printed circuit assembly, which is shielded by the ground plane means from the driven element, for adjusting the effective electrical length of the parasitic element termination line; and FIG. 3 provides more details of the ground plane and the printed circuit assembly as well as the signal connections to the parasitic elements and the driven element.

DETAILED DESCRIPTION

Figure 1:
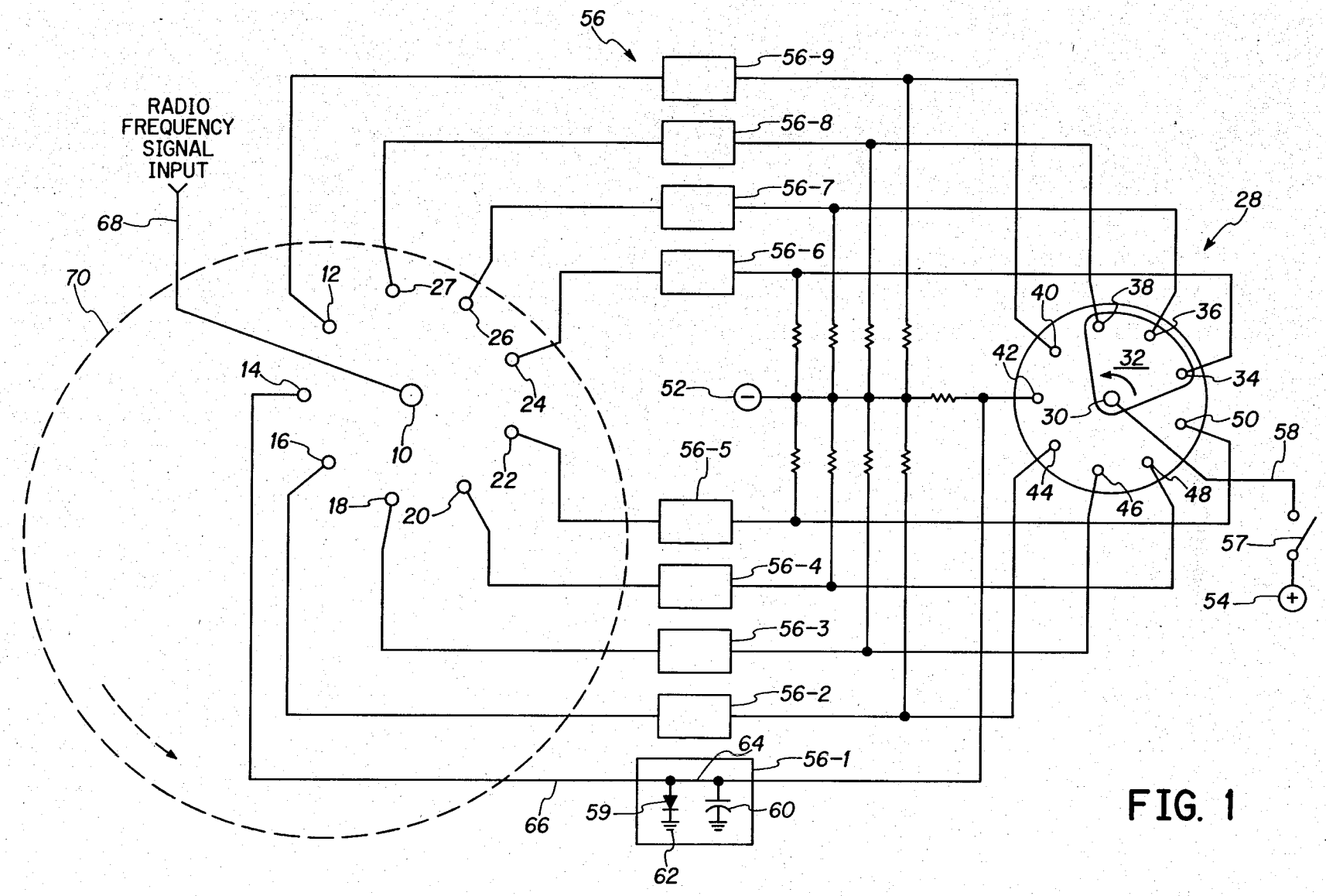

In FIG. 1 a central driven element 10 is illustrated with a plurality of parasitic elements 12, 14, 16, 18, 20, 22, 24, 26 and 27 surrounding the driven element in an equally spaced relationship. There are a plurality of leads connecting these elements to a commutator or switching device generally indicated as 28. The switching element 28 is the mechanical equivalent of an electronic switch used with the device. Within switching element 28 there is shown a central connection or contact 30 and a rotating contact means 32. Contact means 32 rotates in the direction shown by the associated arrow and is presently contacting electrical contact means 34, 36 and 38. The direction of rotation is such that it will soon lose electrical contact with contact means 34 and provide electrical connection to contact means 40. The remaining contact means are listed as 42, 44, 46, 48 and 50. Each of these contacts is connected through a resistor to a negative potential 52. Thus, these contact means are normally biased to a negative potential unless the contact means receives a positive potential from a positive terminal 54 through a switch 57 and a lead 58 which supplies a positive potential to the central commutating contact 30. Between the parasitic elements 12 through 27 and the contact means 34 through 50 are a plurality of blocks 56 shown specifically as elements 56-1 through 56-9. Details are shown in 56-1 that the block contains a pin diode 59 and a capacitor 60. The diode 59 and capacitor 60 are each connected to ground 62 and there is a length of transmission line 64 between the capacitor 60 and the diode 59. Each of the remaining blocks 56 from 56-2 through 56-9 are identically constructed but not shown to reduce the amount of drawing. The length of the line between pin diode 59 and the parasitic element 14 is labeled 66. Although not shown in the drawing, this transmission line length is identical for corresponding connections of the remaining parasitic elements and their associated boxes 56-n. The length of the transmission line elements 64 and 66 are important since the total transmission line length 66 and 64 must be more than ¼ the wavelength of the carrier signal being transmitted while the transmission line element 66 by itself must be substantially less than ¼ the wavelength for the invention to operate according to design. A signal input is provided on a lead 68 to the driven element 10. The signal pattern provided by the antenna apparatus when operating in a directional mode is shown symbolically by the pattern labeled 70. This directional signal strength pattern rotates in the same direction as does the movable contact 32 in commutator 28.

Figure 2:
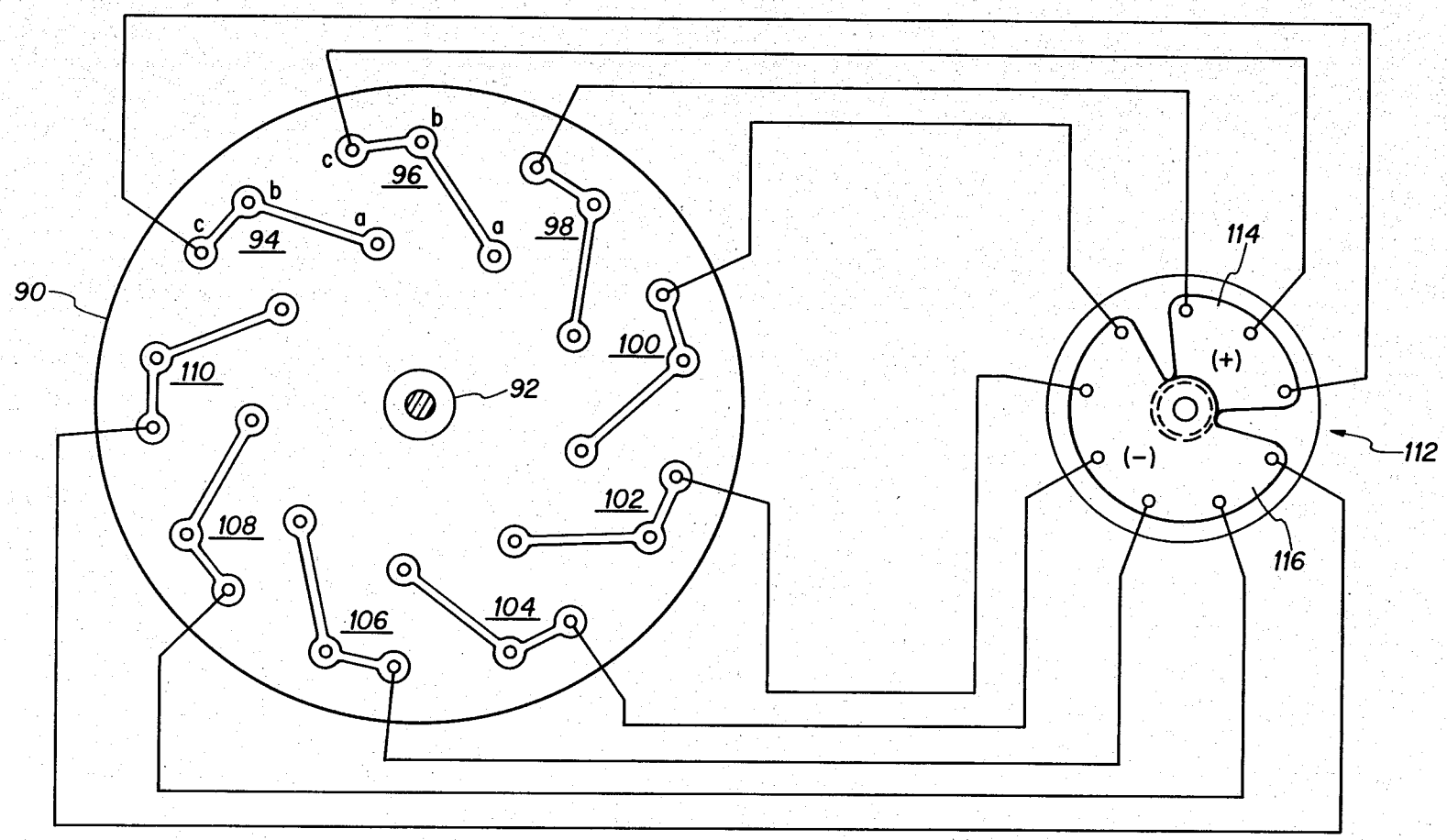

In FIG. 2 a printed circuit card 90 is shown which is mounted on the underside of a ground plane support for the antenna elements. The base portion of the driven element is designated as 92 and a plurality of printed circuit paths are shown designated generally from 94 to 110. Each of these printed circuit paths has junction or termination portions. One of the typical paths 96 is labeled A, B and C. The A portion is connected to a parasitic element such as labeled from 12 through 27 in FIG. 1 whereas the C portion is connected back to a mechanical equivalent of an electronic switch shown in the form of a rotating commutator 112. Commutator 112 has a three contact positive biased portion 114 and a six contact portion biased negatively and designated 116. In one embodiment of the invention, the negative portion 116 was biased to −60 volts and the positive portion was biased to +3.5 volts. The direction of rotation of the commutator is identical to that shown in FIG. 1. In correlating this drawing to FIG. 1, the printed circuit paths 94 through 110 thus include the elements 56 and their associated switching diodes and capacitors. The B portion of each of the printed circuit paths 94 through 110 is the portion connected to the diode for affecting the impedance between the base portion of a parasitic element as connected to A and the signal radiation frequency grounding means comprising a feedthrough capacitor connected at one end to a ground plane.

Figure 3:
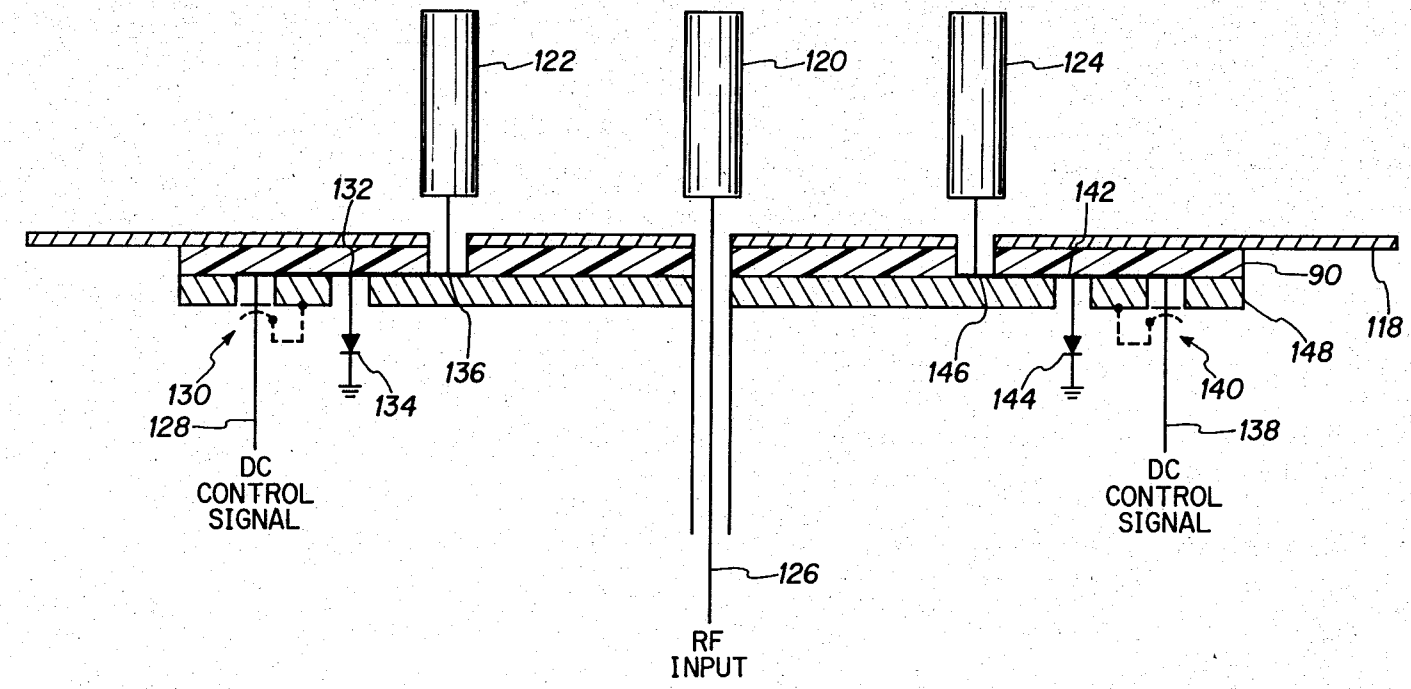

FIG. 3 provides more detail of the antenna portion of FIGS. 1 and 2 wherein the printed circuit element 90 of FIG. 2 is similarly labeled. In addition, a main ground plane is given the designation of 118 and the central driven element is designated 120 while two of the parasitic elements out of the nine possible in one embodiment are designated 122 and 124. As illustrated, an RF signal is supplied to a coaxial input via lead 126 and a DC control signal is applied via a lead 128 through a feedthrough capacitor (shown in dash line format) designated as 130 to a portion of the parasitic element termination line comprising a printed circuit path 132. This path extends from the entry point at the feedthrough capacitor 130 to a pin diode designated as 134 and from there continuing through the termination line to the A portion of the line designated as 136. This portion 136 of the terminating line is then electrically connected to the base portion of element 122. A similar set of designators are illustrated on the righthand side of this drawing using designations 138 through 146. Finally, an additional ground plane or shielding element 148 is shown below the printed circuit board 90. The additional ground plane 148 is electrically connected to the main ground plane 118 and provides additional shielding and a constant impedance for the element terminating lines such as 132 and 142.

OPERATION

The operation of the invention is believed reasonably apparent from the descriptive material already provided but the operation will be restated here.

A signal to be transmitted from the antenna is input on lead 68 to the driven element 10. This supplies a signal which is output in all directions from the element 10. As long as there is a negative signal supplied from terminal 52 through the various resistors to the parasitic elements 12 through 27, the signal is an omnidirectional signal, or in other words, has equal amplitudes at a given distance at any point around the antenna. When switch 57 is closed, a positive signal from source 54 is supplied through the contactor 32 to the three commutator contacts 34 through 38. This, in turn, will break down the pin diodes within blocks 56-6 through 56-8 and transform the parasitic elements 24 through 27 from director type elements to reflector type elements. Since these elements are acting as reflectors, the signal transmitted from driven element 10 is reflected back so as to reinforce signals transmitted toward the elements 12 through 22 and change the shape of the signal strength in the antenna pattern to generally that shown by line or pattern 70.

The operation of the invention is based on the alteration of one or more of parasitic elements (12 to 27) from a director type element to a reflector type element. This basic concept is disclosed in Yagi, as mentioned previously. As disclosed herein, a transmission line comprising sections 64 and 66 are connected to the parasitic element 14 and forms a terminating impedance for same. Similar connections are provided to each of the other parasitic elements and all operate identically. If the impedance connection between the base portion of a parasitic element and ground is capacitively coupled, the parasitic element will act as a director. If, on the other hand, the coupling is inductive, it will act as a reflector. If a transmission line is exactly a ¼ wavelength, its impedance is very high. However, if the transmission line is greater than ¼ wavelength but less than ½ wavelength, it is seen as a capacitive impedance at the base of the parasitic element. On the other hand, if it is less than ¼ wavelength, it is seen as inductive impedance at the base of the parasitic element. The placement of the diode 59 with respect to the lengths of transmission line elements 64 and 66 is somewhat critical to proper operation of the invention. As long as line 64 is biased negatively, assuming the illustrated conditions of connection of the pin diode 59, the diode will not conduct and the parasitic element 14 sees a capacitive loading to ground 62. However, if line 64 is placed at a positive value, the diode 59 will break down and the parasitic element 14 will see only the inductive portion of the line as coupled to ground 62 through diode 59.

The drawing of the printed circuit element in FIG. 2 is basically to scale as concerns the two sections of the terminating transmission line impedance. It will also be noted that the effect of the commutator with two sets of wipers as shown in FIG. 2 is substantially identical to that of the single wiper 32 in FIG. 1 which has a positive voltage which merely overrides the negative voltage supplied by terminal 52 through the various resistors. The arrangement shown in FIG. 2 will provide somewhat less of a waste of power. However, since the actual implementation is all electronic, the illustration of FIG. 2 is probably more representative.

The prior art such as Yagi utilized different lengths of parasitic elements which were connected together or disconnected to provide reflector or director action. Prior art such as the referenced Black, et al., used different length parasitic elements which were switched into or out of operation to change the direction of orientation of the antenna pattern.

The present invention utilizes a fixed mechanical radiating length or dimension for each of the reflector director parasitic elements by altering the terminating impedance between the base portion of each of these elements and ground plane. The terminating impedance is shielded from the radio frequency signals of the driven element 120 by the ground plane 118 as illustrated in FIG. 3. The impedance of this terminating line is maintained at a constant value by the further ground plane or shield element 148. With the terminating impedances substantially enclosed by shielding or grounding means, the stray radio frequency signals will have substantially no effect and the impedance is changed only by the actuation or deactivation of the pin diodes such as 134 and 144 which cause the base of the appropriate parasitic element to be inductively coupled rather than capacitively coupled to ground.

As will be realized from studying FIG. 3, the pin diode such as 134 is directly electrically connected to ground and with the appropriate DC control voltage supplied thereto, causes a short of radio frequency signals to ground. The feedthrough capacitor such as 130 is electrically connected to ground and although this capacitor does not short out DC control signals, the value is high enough that it will be effectively a short at the radio operating frequency.

As will be realized by those skilled in the art, the impingement of radio frequency signals on the parasitic element causes rectification of the signal in the pin diodes. Thus, one embodiment of the invention required an application of −60 volts to the pin diodes to maintain them in a back biased condition so that the terminating impedance would remain capacitively coupled. When the control voltage is raised to +3 volts, the diode is maintained in a shorted or grounded condition and any rectified radio frequency signals merely enhance this control. However, the base portion of the parasitic element is inductively coupled through the terminating line to ground and acts as a reflector rather than as a director.

Although implementation of the inventive concept has been illustrated using simplified switching, it can be readily appreciated that the commutator function of device 28 can be readily obtained either by an electronic commutator whether hardwired or software controlled. Further, the alteration of the coupling between the parasitic elements to ground can be accomplished by many different means and the essential element is that the parasitic elements are of the same mechanical length for operation as director or reflector and they are changed from capacitive to inductive coupling for the purpose of changing the action of the parasitic elements from director elements to reflector elements. When the commutator contact 34 is rotated, the orientation of the signal pattern 70 is changed in directional orientation.

In view of the many alterations which can be made to the specifics of the invention, I wish to be limited not by the scope of the embodiment illustrated but only by the scope of the appended claims wherein.

I claim:

1. Electronically signal direction oriented antenna means comprising, in combination:
   - ground plane means;
   - driven element means mounted on said ground plane means;
   - a plurality of parasitic elements, each of equal length and having a base portion juxtaposed said driven element means and mounted at the base portion on said ground plane means; and
   - selector means, connected to one end of each of said parasitic elements below said ground plane means, for electrically and selectively altering the impedance at the base portion of said parasitic elements from director to reflector means by changing the impedance from capacitive to inductive while maintaining the same mechanical radiating length.

2. Apparatus for altering an omnidirectional antenna signal strength pattern to an eccentric pattern that is electronically direction orientable comprising, in combination:
   - ground plane means;
   - driven radiating element means mounted on said ground plane means but insulated therefrom;
   - a plurality of parasitic elements, each of equal mechanical length and including a base portion mounted on but insulated from said ground plane means, equally spaced about and juxtaposed said driven element means;
   - transmission line means capacitively connecting the base portion of each said parasitic elements to said ground means whereby the impedance of said transmission line means causes said parasitic element to act as a signal director; and
   - bypass means, connected to said transmission line means, for selectively shorting a capacitive portion of the impedance of at least one of said transmission line means to said ground means whereby the associated parasitic element is inductively coupled to ground and thus acts as a signal reflector.

3. Apparatus as claimed in claim 2 wherein said transmission line means is electrically at least as long as ¼ the wavelength of the frequency of the carrier signal passed by the antenna apparatus.

4. Apparatus as claimed in claim 2 wherein there are nine parasitic elements and three at a time are configured as signal reflectors.

5. The method of electronically orienting the signal transmitted from an antenna having a driven element and a plurality of substantially identical mechanical length parasitic elements attached to but insulated from a ground plane comprising the steps of:
   - normally capacitively coupling the parasitic elements to ground below the ground plane where the electrical impedance of the capacitive coupling causes the parasitic elements to form director elements; and selectively inductively coupling at least one of said parasitic elements to ground to alter the impedance to form a reflective element.

6. Apparatus for altering an omnidirectional antenna signal strength pattern to an eccentric pattern that is electronically direction orientable comprising, in combination:

ground means;

driven radiating element means mounted on said ground means;

a plurality of parasitic elements equally spaced about and juxtaposed said driven element means and also mounted at a base portion thereof to said ground means;

a plurality of first means electrically shielded from said elements for capacitively connecting the base portion each of said parasitic elements to said ground means whereby the impedance of said first means causes said parasitic element to act as a signal director; and second means, connected to said first means, for selectively shorting a portion of the impedance of at least one of said first means to said ground means whereby the associated parasitic element is inductively coupled to ground and thus acts as a signal reflector.

7. Apparatus for altering an omnidirectional antenna signal strength pattern to an eccentric pattern that is electronically direction orientable comprising, in combination:

ground means;

driven radiating element means mounted on and electrically insulated from said ground means;

a plurality of substantially mechanically equal length parasitic elements equally spaced about and juxtaposed said driven element means with a base portion of each of said parasitic elements mounted on and electrically insulated from said ground means;

a plurality of first impedance means, electrically shielded by said ground means from said element means, for capacitively connecting the base portion each of said parasitic elements to said ground means whereby the electrical impedance of said first means interacts with said parasitic element whereby it acts as a signal director; and second means, connected to said first impedance means, for selectively electrically altering the impedance at least one of said first means to inductively couple associated said parasitic elements to said ground means whereby the associated parasitic element acts as a signal reflector.

8. Apparatus as claimed in claim 7 wherein there are nine parasitic elements and three at a time are configured as signal reflectors.

* * * * *